United States Patent [19]

Backstein

[11] 4,026,216

[45] May 31, 1977

[54] ARMING FUZE FOR ARTILLERY SHELL

[75] Inventor: Günter Backstein, Meerbusch, Germany

[73] Assignee: Rheinmetall G.m.b.H., Dusseldorf, Germany

[22] Filed: Dec. 5, 1975

[21] Appl. No.: 638,076

[30] Foreign Application Priority Data

Dec. 7, 1974 Germany ..... 2457947

[52] U.S. Cl. ..... 102/79; 102/70.2 R

[51] Int. Cl.[2] ..... F42C 15/22

[58] Field of Search ..... 102/79, 80, 70 R, 70.2 GA

[56] References Cited

UNITED STATES PATENTS

| | | | |
|---|---|---|---|
| 3,030,886 | 4/1962 | Junghans | 102/79 X |
| 3,076,410 | 2/1963 | Guerne | 102/79 |
| 3,489,089 | 1/1970 | Kaiser et al. | 102/79 |
| 3,516,359 | 6/1970 | Weber et al. | 102/79 |
| 3,585,935 | 6/1971 | Birkigt | 102/80 X |

FOREIGN PATENTS OR APPLICATIONS

| | | | |
|---|---|---|---|
| 77,566 | 1/1916 | Austria | 102/79 |
| 234,814 | 10/1944 | Switzerland | 102/79 |

*Primary Examiner*—David H. Brown

*Attorney, Agent, or Firm*—Ernest G. Montague; Karl F. Ross; Herbert Dubno

[57] ABSTRACT

A fuze for an artillery shell to be spun about an axis generally parallel to the direction in which it is fired comprises a housing formed with a central axially extending sleeve and with a chamber surrounding the sleeve. A pin is axially slidable in the sleeve and is retained in position by at least one ball. A spiral spring wound in the chamber around the sleeve normally holds the balls in position to lock the sleeve in place and maintain the fuze in an unarmed condition. This spring comprises a steel inner section lying against the sleeve and normally pressing the balls together against the pin, an outer section having a high coefficient of friction and engageable with the inner surface of the spring-containing chamber, and an intermediate section between the inner and outer sections and having substantially more turns than both of these sections.

7 Claims, 4 Drawing Figures

FIG. 3
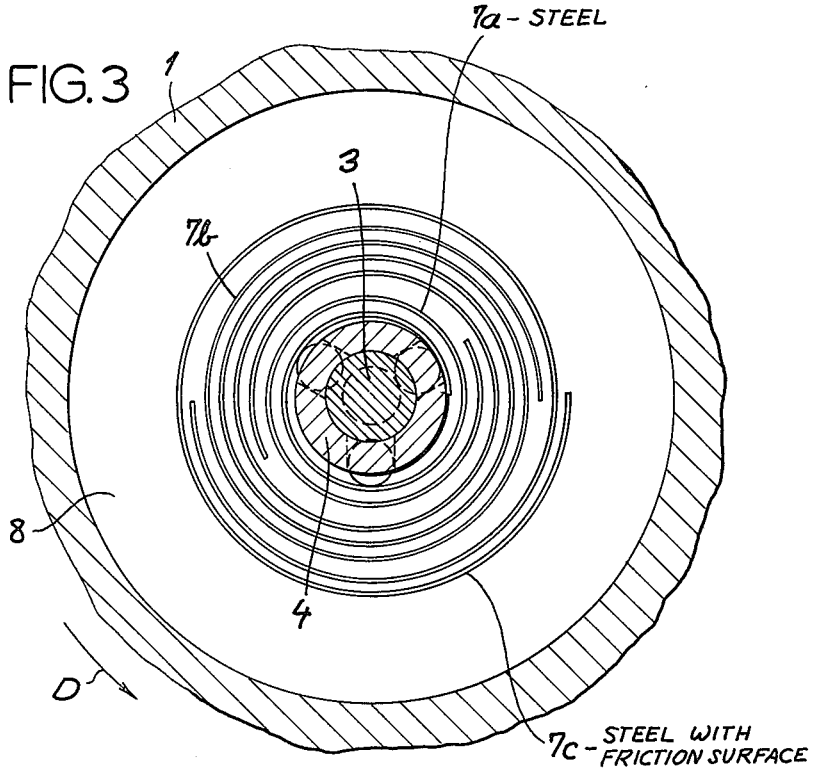
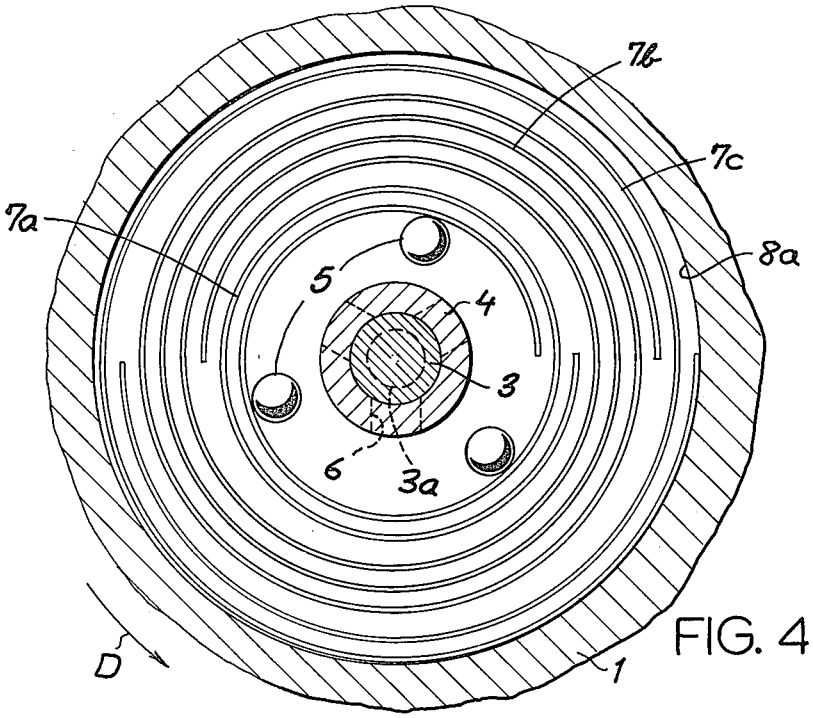
FIG. 4

ARMING FUZE FOR ARTILLERY SHELL

CROSS REFERENCE TO RELATED APPLICATION

This application is related to my copending and commonly owned patent application Ser. No. 638,077 filed Dec. 5, 1975.

FIELD OF THE INVENTION

This application relates to a fuze for an artillery projectile or the like. More particularly this invention concerns a detonator fuze for a projectile that is spun about an axis parallel to its direction of travel, as for instance a projectile fired from a rifled barrel.

BACKGROUND OF THE INVENTION

A detonator fuze is known having a rotor which is aligned centrifugally when the shell is spun at high speeds. A contact or primer pin is engageable against this rotor axially by spring pressure when it has been released by a ball-type detent which is normally held shut by a spring wound about an axis parallel to the direction of displacement. When the shell is fired the rifling of the gun barrel imparts considerable spin to the shell so that the spring pulls away from the ball-type detent, allowing the pin to move into alignment with the centrifugally oriented rotor and arm the projectile. Before the projectile is spun in this manner it is bore safe, that is even accidental dropping or shaking up of the projectile cannot explode it.

This bore safety of the detonator must exist not only prior to firing the projectile, but also for a brief time after it is fired, as the projectile must not explode as soon as it leaves the muzzle of the gun or even be able to explode immediately as it leaves the muzzle. To this end a relatively long spring is wound around the ball-type detent so that a certain period of time is necessary in order for the entire length of spring to unwind and allow the pin to move into the armed position. As a result of this multiturn construction there is considerable friction force so that it is almost impossible to calculate just when the projectile will be armed after it is fired. Furthermore the balls of the detent are themselves urged centrifugally outwardly with considerable force, and frequently press on and deform the inner turns of the spring. This deformation again increases the arming time so that it is not rare in such arrangements that a projectile strikes a given target before it is armed.

It has been suggested to avoid this latter inconvenience, deformation of the inner turns of the spring, by providing a relatively hard split sleeve or the like within the spring, so that a relatively soft spring, for instance made of synthetic- resin material, may be employed. Such an arrangement increases the construction cost of the fuze and adds to its size and bulkiness. Since the fuze must be fitted within a given projectile which is intended to explode and destroy itself, it is essential that the size of the fuze be reduced to a minimum in order to maximize the amount of powder that can be accommodated in the bursting explosive.

OBJECTS OF THE INVENTION

It is an object of the present invention to provide an improved fuze for an artillery shell or the like.

Another object is the provision of such a fuze which arms the projectile a predetermined fixed time after the projectile is fired.

Yet another object is the provision of an improved fuze which is relatively compact and inexpensive to manufacture.

SUMMARY OF THE INVENTION

These objects are attained according to the present invention in a fuze of the above-described general type wherein the spiral spring means is wound in the fuze chamber around the sleeve in which the pin-locking ball or balls are radially displaceable, the spring comprising inner, outer, and spring elements or sections. The inner section lies against the sleeve and normally presses the ball against the pin and is made of a very hard material not deformable by the ball. The outer section has a surface with a high coefficient of friction so as to insure that it engages the inside wall of the spring-containing chamber and unwinds it at a predetermined rate after firing of the shell. The intermediate section is of substantially more turns than both the inner and outer sections and serves almost exclusively to establish the time delay before the projectile is armed after it is fired.

According to other features of this invention the inner and outer sections are wound about the sleeve in the direction of spin of the projectile imparted to this projectile by the rifling of the gun. The intermediate section is wound in the opposite direction. The inner and outer sections are made in accordance with this invention of spring steel and the intermediate section of softer material, such as a high-density polyethylene or a polyamide.

With the system according to the present invention the outer spring section ensures the bore safety and transport safety of the shell as it tightly holds the entire spring packet together. At the same time the inner section is not damaged by the balls holding the operating pin in place so that the unwinding of this inner section can be counted on to take a predetermined length of time. The intermediate section, however, is relatively long, at least twice as long as either of the other two sections, and of easily determined characteristics so that its unwinding can be exactly calculated to take a predetermined length of time. In this manner a relatively inexpensive construction allows a fuze to be employed which renders the shell completely safe before firing and insures that it will be armed a readily ascertainable interval after firing.

BRIEF DESCRIPTION OF THE DRAWING

The above and other features, objects and advantages of the invention will become more readily apparent from the following description, reference being made to the accompanying drawing in which:

FIGS. 3 and 4 are sections taken along lines III — III and IV — IV of FIGS. 1 and 2, respectively.

SPECIFIC DESCRIPTION

Figure 1:
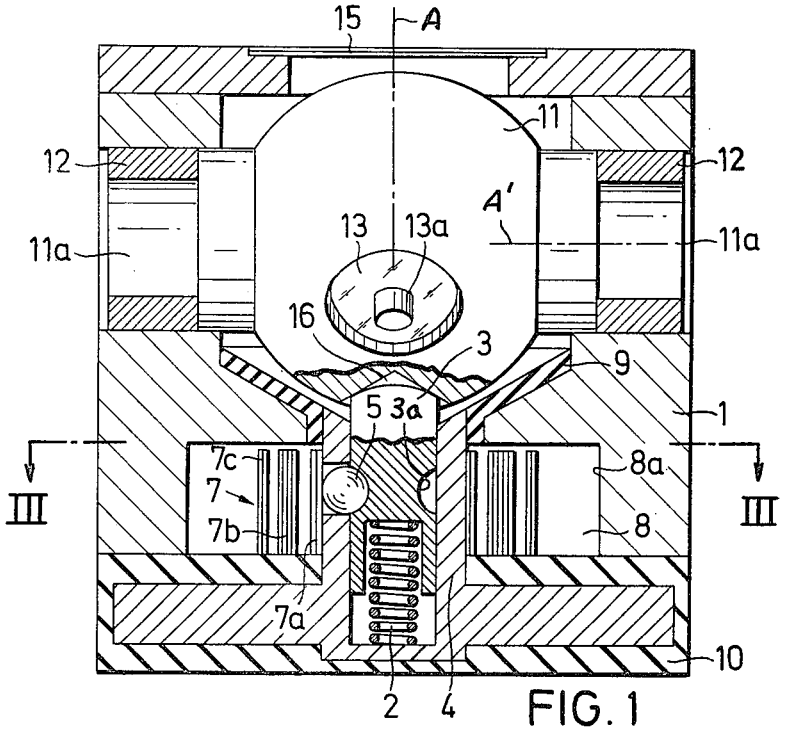
FIG. 1 is a section through a fuze in accordance with this invention in the unarmed position.

The fuze according to the present invention as shown in FIGS. 1–4, has a housing I in which a pin 3 is displaceable along the axis A within an internal sleeve 4. A spring 2 urges the pin 3, which is formed with a circumferential groove 3*a*, upwardly along the axis A. The sleeve 4 is formed with three radially extending holes 6 in each of which is normally received a ball 5 engageable within the groove 3*a* in order to lock the pin 3 axially in position. A spring packet indicated generally at 7 holds the balls in the groove 3*a* normally to maintain the fuze in the unarmed position as shown in FIGS. 1 and 3.

The housing is formed with an annular generally cylindrical chamber 8 surrounding the sleeve 4 and having an inside surface 8*a* turned toward the sleeve 4. The spring pack 7 is received in this chamber 8 and comprises an inner section 7*a* resisting against the balls 5, an intermediate section 7*b*, and an outer section 7*c*. The inner and outer sections 7*a* and 7*c* have a relatively short overall length so that they have much fewer turns than the intermediate section 7*b*. Sections 7*a* and 7*c* are both made of spring steel and the section 7*c* is provided on all of its outside surfaces with a synthetic-resin coating that increases its coefficient of friction with the surface 8*a* and with the intermediate section 7*b*. This surface is also roughened in order to increase its coefficient of friction. Section 7*b* is made of synthetic-resin material, a hard resin of the nylon or polyamide family being employed. The section 7*a* is, as mentioned above, made of spring steel and of sufficient hardness that the steel balls 5 cannot deform it. The sections 7*a* and 7*c* are shown in FIGS. 3 and 4 wound against the direction of spin D of the projectile carrying the fuze housing 1 and the section 7*b* is wound in this direction D.

The sleeve 4 is insulated from the housing 1 by elements 9 and 10. The housing is also provided with a rotor 11 carried on radially extending pins 11*a* received in journals 12 in the housing 1. When spun at a high speed about the axis A the rotor 11 tends to twist about its transverse axis A′ from the position shown in FIG. 1 to the position shown in FIG. 2. The pin 3, however, normally rests in a recess 16 formed in the rotor 11 so as to prevent the rotor 11 from moving into the position of FIG. 2 in which the contact pin 13*a* of a primer 13 is aligned along the axis A with the pin 3. A foil 15 is provided over a window above the rotor 11 to allow the primer 13 to be connected to a conventional fuze or operated in any other manner and also to allow the detonator to be withdrawn from its bore 14 in the rotor 11.

The fuze operates as follows:

Prior to firing, that is during transport, loading, and when in position in the gun bore, the fuze is in the position shown in FIGS. 1 and 3 with the pin 3 seated in the recess 16. The balls 5 lock the pin 3 in this predetermined axial position and prevent the rotor 11 from rotating about its axis A′. Even if the projectile carrying this fuze is dropped or grossly mishandled the elements will remain in this position as only high-speed spinning of the housing 1 about the axis A can unlock these elements relative to one another.

Figure 2:
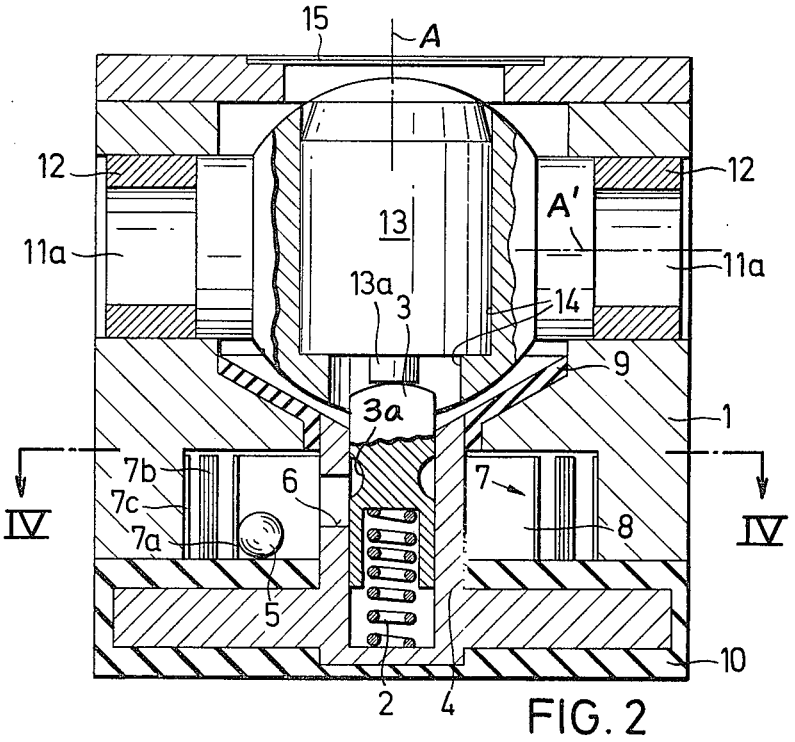
FIG. 2 is a view similar to FIG. 1 showing the fuze in the armed position.

When the shell is fired it is spun about this axis A at a very high speed so that first the outer section 7*c* of the spring packet 7 will suddenly unwind and engage the surface 8*a* of the chamber 8, very quickly unwinding and lying against this surface 8*a*. This frees the spring 7*b* which now unwinds at a very readily determined rate, as it is wound in the direction of spin of the housing 1, and it is in engagement with the surface of the section 7*c* which has a very high coefficient of friction. Once the section 7*b* has fully unwound, taking a relatively long time, the inner section will also very quickly unwind, as it is wound opposite to the direction D. This allows the balls 5 to move radially out of their bores 6 as indicated in FIG. 2.

The pin 3 is now free to move in the direction of axis A. Since the rotor 11 is being urged by centrifugal force to move into position of FIG. 2 it will depress this pin 3, causing it to leave the recess 16, until the contact pin 13*a* is directly axially aligned with the pin 3 whereupon the spring 2 will push the pin 3 up against this pin 13*a*. An electrical connection is now made between the pin 3 and the contact pin 13*a* so that the primer 13 is armed. Firing of this primer 13 can be effected by an electrical current passed between the sleeve 4 and the primer 13 by an impact fuze or the like such as described in the above-cited commonly filed patent application.

Since the intermediate section 7*b* is relatively long and is wound in the direction of rotation of the fuze, its unwinding time can be relatively easily ascertained and controlled within very strict limits. Thus the shell can be counted on to become armed at a predetermined instant after it leaves the muzzle of the gun. At the same time the relatively hard section 7*a* is not marred by the balls so that it also unwinds rapidly, and the section 7*c* having a high coefficient of friction also unwinds rapidly. Both of these sections 7*a* and 7*c* are wound against the direction of rotation D of the fuze so that their unwinding time is nominal compared to the unwinding time of the intermediate multiturn section 7*b*.

It is noted that in FIGS. 3 and 4 the spiral springs 7*a*–7*c* are shown with their individual turns spaced apart for clarity of view. In reality in both positions corresponding to FIGS. 3 and 4 the turns of each spring 7*a*, 7*b* and 7 *c* lie on one another and each such spring lies directly on the neighboring spring.

I claim:

1. A fuze for an artillery shell to be spun about an axis generally parallel to the direction it is fired, said fuze comprising:
   - a housing formed with a central axially extending sleeve, an inner surface facing said sleeve, and a chamber between said sleeve and said inner surface;
   - a pin axially slidable in said sleeve;
   - at least one ball radially displaceable in said sleeve and radially engageable against said pin to arrest same; and
   - spiral spring means in said chamber around said sleeve and including
     - an inner spring element lying against said sleeve and normally pressing said ball against said pin, said inner element being of very hard material not deformable by said ball,
     - an outer spring element engageable with said inner surface and having a surface with a high coefficient of friction, and
     - an intermediate spring element between said inner and outer section and having substantially more turns than both said inner and outer elements.

2. The fuze defined in claim 1 wherein said inner and outer elements are wound about said sleeve in the direction of spin of said projectile and said intermediate element is wound in the opposite direction.

3. The fuze defined in claim 2 wherein said outer element is coated with a synthetic-resin material having a high coefficient of friction.

4. The fuze defined in claim 2 wherein said inner and outer elements are steel.

5. The fuze defined in claim 2, further comprising a rotor pivotal in said housing about a transverse axis extending perpendicular to the spin axis between a pair of pivotally offset positions and having a recess positioned to receive said pin in one of said positions and a contact member alignable with said pin in the other of said positions.

6. The fuze defined in claim 2 wherein said outer element has a roughened surface.

7. The fuze defined in claim 2 wherein said intermediate element has at least twice as many turns as either said inner or said outer element.

* * * * *